United States Patent [19]

Mickey

[11] Patent Number: 4,991,068

[45] Date of Patent: Feb. 5, 1991

[54] LAMP ATTACHMENT FOR HAT

[76] Inventor: Scott A. Mickey, 7358 Riverside Pl., Orlando, Fla. 32810

[21] Appl. No.: 480,063

[22] Filed: Feb. 14, 1990

[51] Int. Cl.[5] ..... F21L 15/14

[52] U.S. Cl. ..... 362/106; 362/288; 362/427

[58] Field of Search ..... 362/103, 105, 106, 288, 362/287, 427, 285, 418

[56] References Cited

U.S. PATENT DOCUMENTS

| | | | |
|---|---|---|---|
| 539,192 | 5/1895 | Rodriguez et al. . | |
| 897,588 | 9/1908 | Cogswell et al. . | |
| 1,146,979 | 7/1915 | Walters et al. | 362/106 |
| 1,532,206 | 4/1925 | Snow | 362/288 |
| 1,559,451 | 10/1925 | Parker | 362/106 |
| 1,744,777 | 1/1930 | Lundgren | 362/106 |
| 2,421,643 | 6/1947 | Ostli | 240/59 |
| 2,448,240 | 8/1948 | Walworth | 240/60 |
| 2,524,881 | 10/1950 | Chambers | 240/10.6 |
| 3,133,705 | 5/1964 | Eickelman | 362/106 |
| 4,406,040 | 9/1983 | Cannone | 24/3 J |
| 4,473,869 | 9/1984 | De Widt | 362/427 X |
| 4,593,683 | 6/1986 | Blaha | 362/106 X |

*Primary Examiner*—Stephen F. Husar
*Assistant Examiner*—Peggy A. Neils
*Attorney, Agent, or Firm*—James H. Beusse

[57] ABSTRACT

In combination, a baseball style cap has a crown portion, a bill portion, and a portion for mounting a high intensity lamp to the bill portion. The mounting portion comprises a relatively stiff steel support rod having a first end bent so as to be located in a plane parallel to the bill of the hat for attachment thereto. Another portion of the support extends in an upwardly angled direction from the first end, and a second end extends substantially normal to a plane defined by the first end. The portion of the support bent in an upwardly angled direction and the connection portion are attached to an outer surface of the lamp for receiving the second end of the lamp support. The connection portion comprises an outer non-resilient tube bonded to the lamp and an inner resilient tube inserted into the outer tube. The second end of the lamp support is press-fit into the inner tube to establish a pivotable connection between the lamp and the lamp support and having a fit such that the lamp is retained in an angular orientation into which it is manually positioned.

9 Claims, 1 Drawing Sheet

LAMP ATTACHMENT FOR HAT

The present invention relates to head mounted lamps and, more particularly, to an improved combination of hat and lamp mounted thereto.

BACKGROUND OF THE INVENTION

Lamps have been mounted to headgear for many years. Most well known, perhaps, is the old style carbide lamp mounted on miners' hard hats. More recently, carbide lamps have been replaced by battery powered lamps. When such lamps have been mounted on hard hats, little concern has been expressed for the mounting technique since hard hats provide adequate support. However, there are other applications for head mounted lamps in which it is desirable to reduce the weight of the lamp and to provide relatively stable mounting. For example, night fishermen commonly wear lightweight baseball style caps either formed entirely of cloth or with a cloth bill or brim and a plastic mesh crown. Most prior art lamps would either not be supportable on such caps or would be too uncomfortable for long use.

One attempt to solve the problem of weight for such head mounted lamps has been to mount the batteries for a lamp separately from the lamp, such as on a waist belt, and to connect the cap by long wire. Another alternative is to mount a single cell powered incandescent bulb and battery on the brim of a cap, which alternative may be sufficient when relatively little light is desired. In general, none of the prior art devices have provided satisfactory arrangements of high intensity lighting with integral batteries and multi-positional lamps.

SUMMARY OF THE INVENTION

It is an object of the present invention to provide a combination hat and lamp which overcomes the above and other disadvantages of the prior art.

It is another object of the present invention to provide a mounting arrangement for a high intensity lamp which permits control of light direction and integral battery storage.

In one form, a combination hat and spot light is provided with the hat having a crown, a bill extending from the crown, a liner circumscribing at least a portion of an edge of the crown, and an adjustable strap operatively associated with the crown for adjusting the hat to various different head sizes. The liner comprises a strip of material having an upper edge, a lower edge, and first and second ends. The lower edge is securely fastened to a bottom edge of the crown with the upper edge laying against an inner surface of the crown, while the first and second ends are attached to respective ends of the adjustable strap.

The combination of the present invention includes a hermetically sealed push button switch mounted to the bill of the hat near an edge thereof. First and second battery holders are located respectively on opposite sides of the crown of the hat between the crown and the liner. First and second wires extend from the push button switch and continue through an opening in the crown and an opening in the liner with the first wire connected to one end of the first battery holder and the second wire extending in a direction away from the first wire and terminating in a first wire connector located between the crown and the liner. A third wire originates from one end of the second battery holder and extends around the crown between the crown and liner and is connected to another end of the first battery holder for effecting a series electrical circuit between the first and second battery holders.

In addition, the present invention includes a high intensity xenon lamp which has first and second electrical connections for coupling electrical power to the lamp. First and second wires are connected respectively to the first and second electrical connections on the lamp, extend along, and are clamped to an upper surface of the bill. The wires further extend through an aperture in the crown adjacent the bill with the first wire from the lamp connected to another end of the second battery holder, and the second wire from the lamp coupled to the second wire from the switch at the first wire connector. A support for the lamp comprises a relatively stiff support rod having a first end bent so as to be located in a plane parallel to the bill of the hat for attachment thereto, while another portion of the support extends in an upwardly angled direction from the first end, and a second end extends substantially normal to a plane defined by the first end and the other portion. Attached to an outer surface of the lamp for receiving the second end of the lamp support is a connection means comprising an outer non-resilient tube bonded to the lamp and an inner resilient tube inserted into the outer tube. The second end of the lamp support is press-fit into the inner tube to establish a pivotable connection between the lamp and the lamp support and has a fit such that the lamp is retained in any angular orientation into which it is manually positioned.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
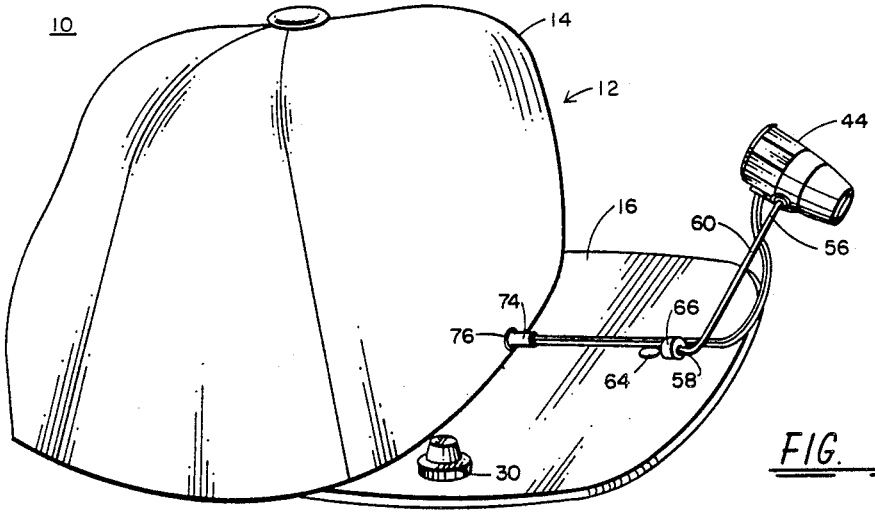
FIG. 1 is a front perspective view of a lamp and cap combination in accordance with the present invention.
Figure 2:
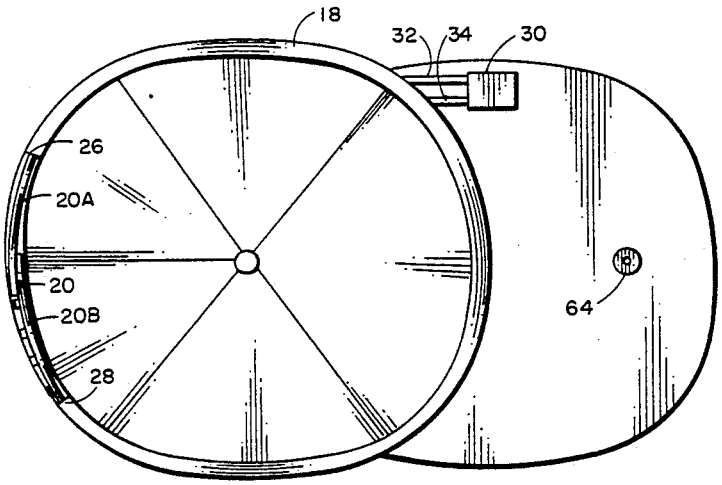
FIG. 2 is a bottom view of the cap and lamp of FIG. 1.
Figure 4:
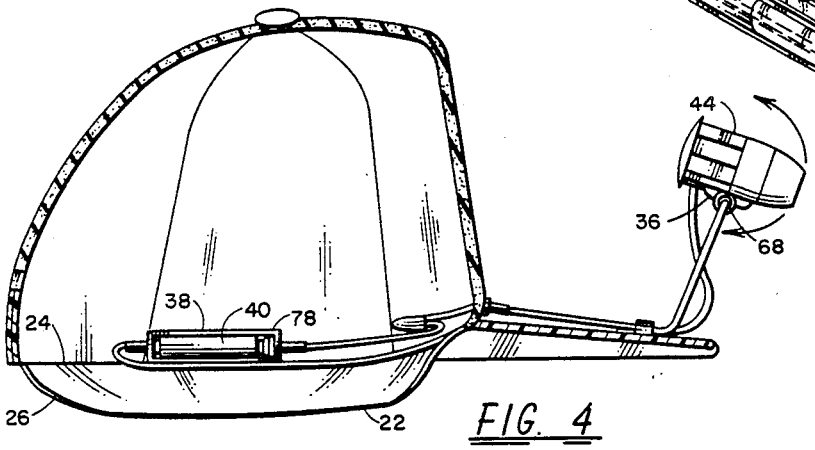
FIG. 4 is a cross-sectional view taken through the cap of FIG. 1 showing the battery mounting arrangement.

Referring generally to FIGS. 1, 2, and 4 there is shown a combination hat and spot light 10 comprising a baseball style cap or hat 12 having a crown 14, a brim or bill 16, a liner 18 circumscribing at least a portion of the lower edge of the crown 14 and a strap 20 comprising two adjustably connectable sections 20A and 20B which may be fastened together to fit the crown of the hat to various different head sizes. The liner, best seen in FIG. 4, comprises a strip of material having an upper edge 22, a lower edge 24, and first and second ends 26 and 28. The lower edge 24 of the liner 18 is fastened to the crown 14 generally by sewing the edges of the crown and liner together. The upper edge 22 is folded upward during normal use so that it lies against an inner surface of the crown.

The lamp assembly comprises a hermetically sealed push button switch 30 mounted to the bill 16 near a right-hand edge thereof. The switch 30 may be a typical screw mounted type of switch which extends through an aperture in the bill of the cap and has a threaded portion adapted for receiving a nut to attach the switch to the cap bill. The upper part of the switch is enclosed by a rubber or flexible cover to prevent entry of water or other moisture into the switch. A pair of wires 32 and 34 exit the bottom of the switch below the bill of the cap and extend through an aperture adjacent the junction between the liner 18 and crown 14. This places the wires 32 and 34 into the space between the liner 18 and crown 14 when the liner 18 is in its normal upwardly folded position.

As best seen in FIG. 4, a battery holder is attached to the crown 14 adjacent a lower edge thereof and is normally located between the liner 18 and the crown 14. The battery holder 38 is preferably a AAA size battery holder for containing a single AAA cell 40. However, a pair of battery holders are used with the battery holders being positioned on opposite sides of the cap 12 between the liner and crown 14. Applicant has found that by using a single cell battery holder on each side of the cap mounted between the liner and the cap crown, the padding normally found in the perspiration absorbing liner is sufficient to protect the wearer's head and to avoid any sensation of pressure from the individual battery holders. The wires 32 and 34 from the push button switch 30 extend into the space between the liner and cap crown with one of the wires being connected to one end of one of the battery holders and the other wire terminating in a junction for connection to another wire to be described hereinafter. Still another wire 42 extends from one end of the battery holder 38 around the rim of the crown 14 beneath the liner 18 and connects to an end of the battery holder (not shown) on the opposite side of the cap. As will become apparent, this connection will place the two battery holders in a series electrical circuit so that the two batteries combine in an additive fashion to provide double the voltage of one of the batteries to a lamp holder 44 connected to the bill of the hat.

Figure 3:
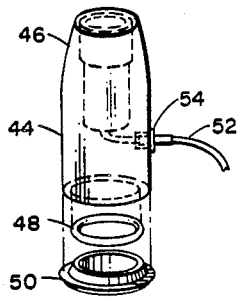
FIG. 3 is a partially-exploded view of the xenon lamp mounted on the cap in FIG. 1.

The lamp holder 44 is preferably a high intensity xenon lamp of a type commercially available and may be in the order of three centimeters in length and approximately two centimeters in diameter. FIG. 3 is a partially exploded view of this type of xenon lamp and shows that the major components or electrical components of the lamp comprise only a small portion of the entire lamp holder 44. In particular, the lamp itself measures approximately one centimeter in diameter and has a total length of about 1 and ¼ centimeters. The electrical portion of the lamp is indicated at 46 in phantom lines. The remainder of the lamp is contained with the holder 44 and comprises a seal 48 and a rear cover 50 which hermetically seals the lamp 46 from moisture or other contaminants. The rear cover 50 may be adhesively bonded to the lamp holder 44. The connecting wires 52 going to the lamp 46 are typically epoxy mounted in an aperture 54 passing through the holder 44.

The lamp holder 44 is supported above the bill 16 on a stainless steel rod 56. The rod 56 has a first end 58 which is bent so as to lie flat on the upper surface of the bill 16. A middle portion 60 of the rod 56 extends upward in an angular direction from the bill 16 for supporting the lamp holder 44 in a displaced position above the bill. The rod 56 terminates in an upper portion which extends normal to a plane passing through the middle portion 60 and lower portion 58. The direction of orientation of the upper portion 62 allows the lamp holder 44 to pivot in a vertical plane when the cap 12 is worn in its normal position. The lower end 58 of the rod 56 is attached to a rivet 64 which passes through the bill 16 and is compressed to attach the rod 56 to the bill. A sleeve 66 passes around the rod portion 58 and around the wires 52 to hold the wires 52 along the surface of the bill 16.

Figure 5:
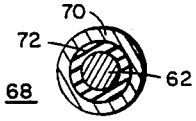
FIG. 5 is a cross-sectional view of the pivotable connecting means for mounting the xenon lamp to a lamp support on the cap of FIG. 1.

The lamp housing 44 is attached to the rod 56 by means of the upper portion 62 utilizing a connection means 68. The connection means 68 is bonded to the lamp housing 44 by means well known in the art, such as, for example, by an adhesive indicated at 36. As shown in FIG. 5, the connection means 68 comprises an outer tubular sleeve 70, preferably formed of a metal or other non-resilient material. Within the sleeve 70 there is an inner sleeve 72 which is preferably formed of a resilient material such as, for example, a silicon rubber tube. The end 62 of the rod 56 is press-fit into the inner tubular member 72. This arrangement provides a compression fit about the rod end 62 and assures that the lamp holder 44 will not freely rotate about the rod end 62 without external manual pressure. The lamp holder can thus be positioned in any desired vertical orientation and will remain in that position until manually repositioned.

The wires 52 extending from the lamp holder 44 pass through an aperture 74 in the crown 14 just above the upper surface of the bill 16. Preferably, the aperture 74 includes a grommet 76 securely fastened therein so as to prevent further tearing or unraveling of the hat material. As the wires 52 enter the area inside the crown of the hat, one of the wires is connected to an end 78 of battery holder 38 while another of the wires is connected to the connection from the switch 30. This arrangement provides a series circuit between the switch, the two battery holders, and the lamp 46. When the switch 30 is actuated, the circuit is completed so that the two batteries provide electrical power to the lamp 46.

It will be appreciated that what has been described is a lightweight high intensity lamp arrangement for use with a cloth or similar material type of baseball cap which can be worn in relative comfort. The miniature lamp as described above is relatively small and is preferably a pre-focused sealed beam xenon lamp having a weight of less than one-half ounce. The battery holders are miniature holders each designed to hold a single AAA size battery cell. The lamp holder is uniquely mounted on a stainless steel rod which is relatively stiff and thus not susceptible to easy deflection. The lamp can be tilted at various different angular positions in a vertical plane and will retain the angular position unless manually moved.

Figure 6:
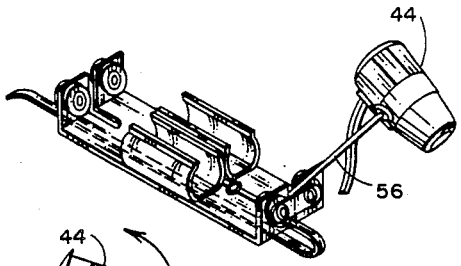

While the invention has been described in what is presently considered to be a preferred embodiment, other modifications will become apparent to those skilled in the art. For example, it is possible to mount a pair of batteries in a dual battery holder such as is shown in FIG. 6 and to attach this battery holder to the front edge of a cap by means of a large hairpin-like spring clamp. The lamp holder 44 and lamp holding rod 56 may be then attached to the battery holders and supported as described with regard to the preferred embodiment above on the upper surface of the bill 16. A small switch may be attached to this combination to provide a means for turning the lamp on and off. Thus, it is therefore not intended that the invention be limited to the specific disclosed embodiment but that it be interpreted within the full spirit and scope of the appended claims.

What is claimed is:

1. A combination hat and spot light, the hat having a crown, a bill extending from the crown, a liner circumscribing at least a portion of an edge of the crown, and an adjustable strap operatively associated with the crown for adjusting the hat to various different head sizes, the liner comprising a strip of material having an upper edge, a lower edge, and first and second ends, the lower edge being securely fastened to a bottom edge of the crown with the upper edge laying against an inner surface of the crown, the first and second ends being attached to respective ends of the adjustable strap, the combination including:

a hermetically sealed push button switch mounted to the bill of the hat near an edge thereof;

first and second battery holders each located respectively on opposite sides of the crown of the hat between the crown and the liner;

first and second wires extending from the push button switch and continuing through an opening in one of the crown and the liner, the first wire being connected to one end of the first battery holder and the second wire extending in a direction away from said first wire and terminating in a first wire connector located between the crown and the liner;

a third wire originating from one end of the second battery holder, said wire extending around said crown between the crown and liner and being connected to another end of the first battery holder for effecting a series electrical circuit between said first and second battery holders;

a high intensity xenon lamp having first and second electrical connections for coupling electrical power to the lamp;

first and second wires connected respectively to the first and second electrical connections on said lamp, said wires extending along and being clamped to an upper surface of the bill, said wires extending through an aperture in the crown adjacent the bill, the first wire from the lamp being connected to another end of the second battery holder, the second wire from the lamp being coupled to the second wire from the switch at the first wire connector;

a lamp support comprising a relatively stiff support rod having a first end bent so as to be located in a plane parallel to the bill of the hat for attachment thereto, another portion extending in an upwardly angled direction from the first end, and a second end extending substantially normal to a plane defined by the first end and the another portion; and connection means attached to an outer surface of the lamp for receiving the second end of the lamp support, the connection means comprising an outer non-resilient tube bonded to the lamp and an inner resilient tube inserted into the outer tube, the second end of the lamp support being press-fit into the inner tube to establish a pivotable connection between the lamp and the lamp support and having a fit such that the lamp is retained in any angular orientation into which it is manually positioned.

2. The combination as set forth in claim 1 wherein the inner tube in the connection means comprises silicon rubber tubing.

3. The combination as set forth in claim 1 wherein connection means is attached to an underside of the lamp and the lamp support extends above the bill of the hat to maintain the lamp above the bill in any angular orientation.

4. The combination as set forth in claim 1 wherein the lamp comprises a miniature, pre-focused, sealed beam lamp.

5. The combination as set forth in claim 3 wherein the lamp support comprises a stainless steel rod.

6. The combination as set forth in claim 1 and including a plurality of miniature cable clamps space about a lower edge of the hat crown and passing therethrough for fastening the wires to the crown.

7. The combination as set forth in claim 1 wherein each of the battery holders comprises a holder for a single AAA size battery.

8. The combination as set forth in claim 1 wherein the aperture in the crown for passing the wires from the lamp includes a grommet for preventing tearing of the aperture.

9. In combination, a baseball style cap having a crown portion and a bill portion and means for mounting a high intensity lamp to the bill portion, the mounting means comprising a relatively stiff steel support rod having a first end bent so as to be located in a plane parallel to the bill of the hat for attachment thereto, another portion extending in an upwardly angled direction from the first end, and a second end extending substantially normal to a plane defined by the first end and the another portion and connection means attached to an outer surface of the lamp for receiving the second end of the lamp support, the connection means comprising an outer non-resilient tube bonded to the lamp and an inner resilient tube inserted into the outer tube, the second end of the lamp support being press-fit into the inner tube to establish a pivotable connection between the lamp and the lamp support and having a fit such that the lamp is retained in any angular orientation into which it is manually positioned.

* * * * *